US006789979B1

(12) United States Patent
Jones

(10) Patent No.: US 6,789,979 B1
(45) Date of Patent: Sep. 14, 2004

(54) HIGHWAY SAFETY NET

(76) Inventor: Herbert R. Jones, 1817 Davis Acres Dr., Alpine, AL (US) 35014

( * ) Notice: Subject to any disclaimer, the term of this patent is extended or adjusted under 35 U.S.C. 154(b) by 0 days.

(21) Appl. No.: 10/441,299

(22) Filed: May 15, 2003

(51) Int. Cl.[7] ..... E01F 15/06
(52) U.S. Cl. ..... 404/6; 256/13.1; 244/110 C
(58) Field of Search ..... 256/1, 13.1, 12.5; 244/110 C, 110 R, 110 F; 404/6, 9, 10

(56) References Cited

U.S. PATENT DOCUMENTS 2,465,936 A * 3/1949 Schultz ..... 244/110 R
3,367,608 A * 2/1968 Charno et al. ..... 244/110 R
3,468,500 A * 9/1969 Carlsson ..... 244/110 R
4,056,247 A * 11/1977 Bernard et al. ..... 244/110 C
4,730,810 A * 3/1988 Rambaud ..... 256/12.5
4,819,915 A * 4/1989 Cargnel ..... 256/12.5
4,979,701 A * 12/1990 Colarik et al. ..... 244/110 C
H001133 H * 2/1993 Bridges et al. ..... 244/110 C
2003/0016996 A1 * 1/2003 Gelfand et al. ..... 404/6

FOREIGN PATENT DOCUMENTS

EP 462818 A1 * 12/1991
GB 2232431 A * 12/1990

* cited by examiner

*Primary Examiner*—Robert E. Pezzuto
*Assistant Examiner*—Alexandra Pechhold

(57) ABSTRACT

A highway safety net for catching and controlling a vehicle travelling towards the opposite direction of traffic comprises netting connected to a lower cable. A first post top is connected to the netting for supporting the netting. A second post top is connected to the first post top. A first stabilizer bar is connected to the lower cable. The first stabilizer bar is connected adjacent to the first post bottom. A second stabilizer bar is connected to the lower cable. The second stabilizer bar is connected adjacent to the second post bottom.

5 Claims, 4 Drawing Sheets

HIGHWAY SAFETY NET

BACKGROUND OF THE INVENTION

1. Field of the Invention

The present invention relates to a highway safety net for use in connection with shock absorbing devices. The highway safety net has particular utility in connection with self supporting highway barricade net.

2. Description of the Prior Art

Highway safety nets are desirable for catching and stopping out of control vehicles at grass highway medians.

The use of shock absorbing devices is known in the prior art. For example, U.S. Pat. No. 2,465,936 to Schultz discloses an emergency arresting device for moving objects that comprises a pair of supports and a plurality of horizontal plies attached to the supports. The horizontal plies being constructed of a synthetic plastic material susceptible of at least 100% permanent elongation. However, the Schultz '936 patent does not have a net connected to spaced posts wherein a heavy cable is connected to the net and has stabilizer bars connecting the cable to the spaced posts.

Similarly, U.S. Pat. No. 3,468,500 to Carlsson discloses an arresting gear for aircraft and other vehicles that comprises a net having upper and lower cables. The upper cable consists of a plurality of separate lines or strands. Vertical lines connect the upper and lower cables. Each of the vertical lines is connected at one end to a single one of the strands of the upper cable. However, the Carlsson '500 patent does not have a net connected to spaced posts wherein a heavy cable is connected to the net and has stabilizer bars connecting the cable to the spaced posts.

Lastly, U.S. Pat. No. 3,367,608 to Charno, et al. discloses a barricade net arresting system that is designed to raise and lower a cross-runway barricade member such as a textile net adapted to be engaged by a distressed aircraft which would otherwise over run the safe limits of the runway. A pair of stanchions at opposite sides of the runway support the net. Each stanchion is operated by a hydraulic system synchronized by a unified control. A cylinder is actuated by the hydraulic fluid to raise or lower each stanchion in unison. A feature of each hydraulic system includes an automatic accumulator and recharge. However, the Charno, et al. '608 patent does not have a net connected to spaced posts wherein a heavy cable is connected to the net and has stabilizer bars connecting the cable to the spaced posts.

While the above-described devices fulfill their respective, particular objectives and requirements, the aforementioned patents do not describe a highway safety net that allows self supporting highway barricade net. The Schultz '936, Carlsson '500 and Charno, et al. '608 patents make no provision for a net connected to spaced posts wherein a heavy cable is connected to the net and has stabilizer bars connecting the cable to the spaced posts.

Therefore, a need exists for a new and improved highway safety net which can be used for self supporting highway barricade net. In this regard, the present invention substantially fulfills this need. In this respect, the highway safety net according to the present invention substantially departs from the conventional concepts and designs of the prior art, and in doing so provides an apparatus primarily developed for the purpose of self supporting highway barricade net.

SUMMARY OF THE INVENTION

In view of the foregoing disadvantages inherent in the known types of shock absorbing devices now present in the prior art, the present invention provides an improved highway safety net, and overcomes the above-mentioned disadvantages and drawbacks of the prior art. As such, the general purpose of the present invention, which will be described subsequently in greater detail, is to provide a new and improved highway safety net and method which has all the advantages of the prior art mentioned heretofore and many novel features that result in a highway safety net which is not anticipated, rendered obvious, suggested, or even implied by the prior art, either alone or in any combination thereof.

To attain this, the present invention essentially comprises netting connected to a lower cable. A first post top is connected to the netting for supporting the netting. A second post top is connected to the first post top. A first stabilizer bar is connected to the lower cable. The first stabilizer bar is connected adjacent to the first post bottom. A second stabilizer bar is connected to the lower cable. The second stabilizer bar is connected adjacent to the second post bottom.

There has thus been outlined, rather broadly, the more important features of the invention in order that the detailed description thereof that follows may be better understood and in order that the present contribution to the art may be better appreciated.

The invention may also include a catch, a first stabilizer hook, a second stabilizer hook, a first cement footing, a second cement footing and cable weights. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved highway safety net that has all of the advantages of the prior art shock absorbing devices and none of the disadvantages.

It is another object of the present invention to provide a new and improved highway safety net that may be easily and efficiently manufactured and marketed.

An even further object of the present invention is to provide a new and improved highway safety net that has a low cost of manufacture with regard to both materials and labor, and which accordingly is then susceptible of low prices of sale to the consuming public, thereby making such highway safety net economically available to the buying public.

Still another object of the present invention is to provide a new highway safety net that provides in the apparatuses and methods of the prior art some of the advantages thereof, while simultaneously overcoming some of the disadvantages normally associated therewith.

Lastly, it is an object of the present invention is to provide a highway safety net for self supporting highway barricade net.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
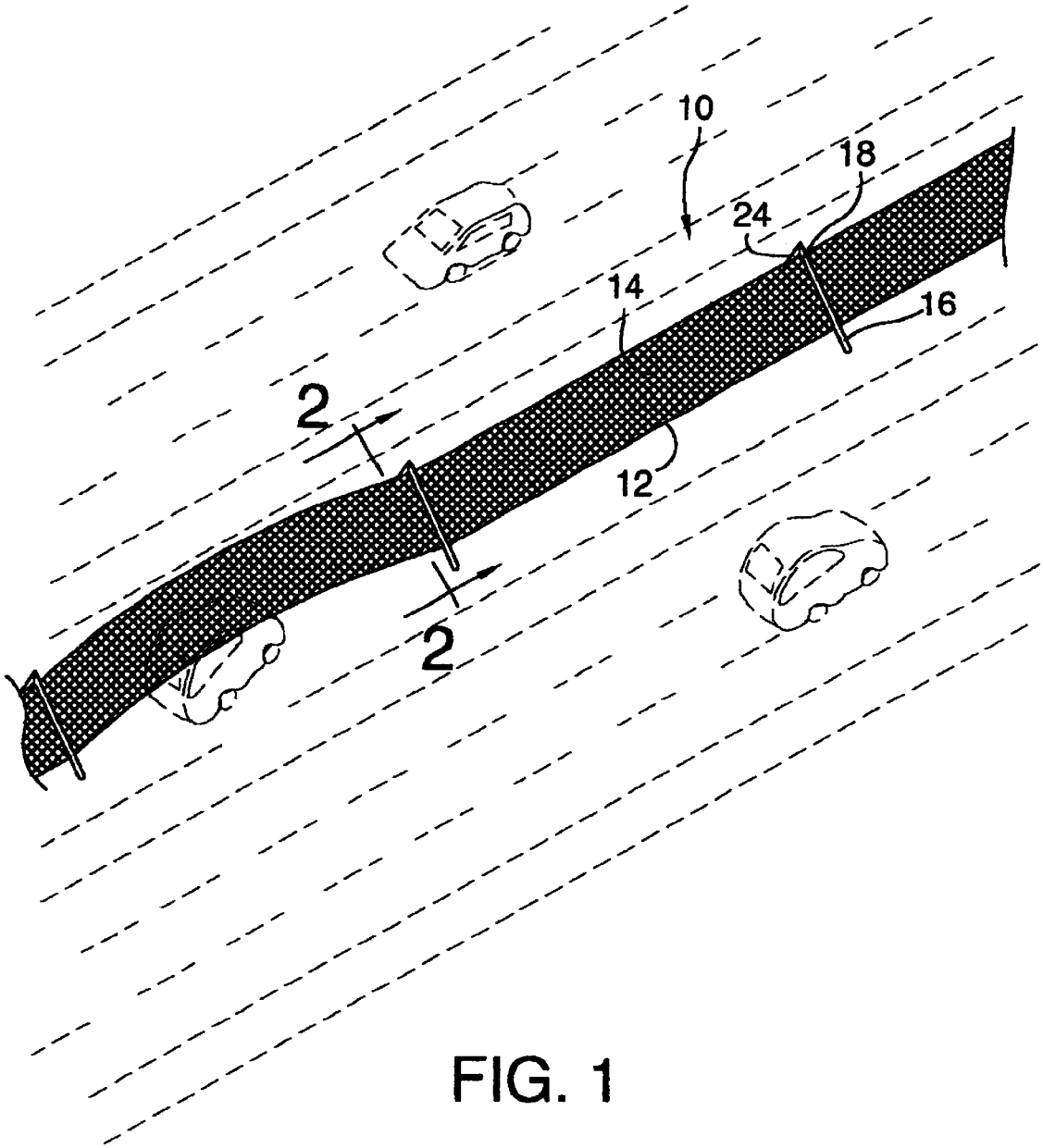
FIG. 1 is a top perspective view of the preferred embodiment of the highway safety net constructed in accordance with the principles of the present invention.

Referring now to the drawings, and particularly to FIGS. 1–4, a preferred embodiment of the highway safety net of the present invention is shown and generally designated by the reference numeral 10.

In FIG. 1, a new and improved highway safety net 10 of the present invention for self supporting highway barricade net is illustrated and will be described. More particularly, the highway safety net 10 has a netting 14 connected to a lower cable 12 (shown in FIG. 2). A first post top 18 is connected to the netting 14 for supporting the netting 14. A second post top 24 is connected to the first post top 18.

Figure 2:
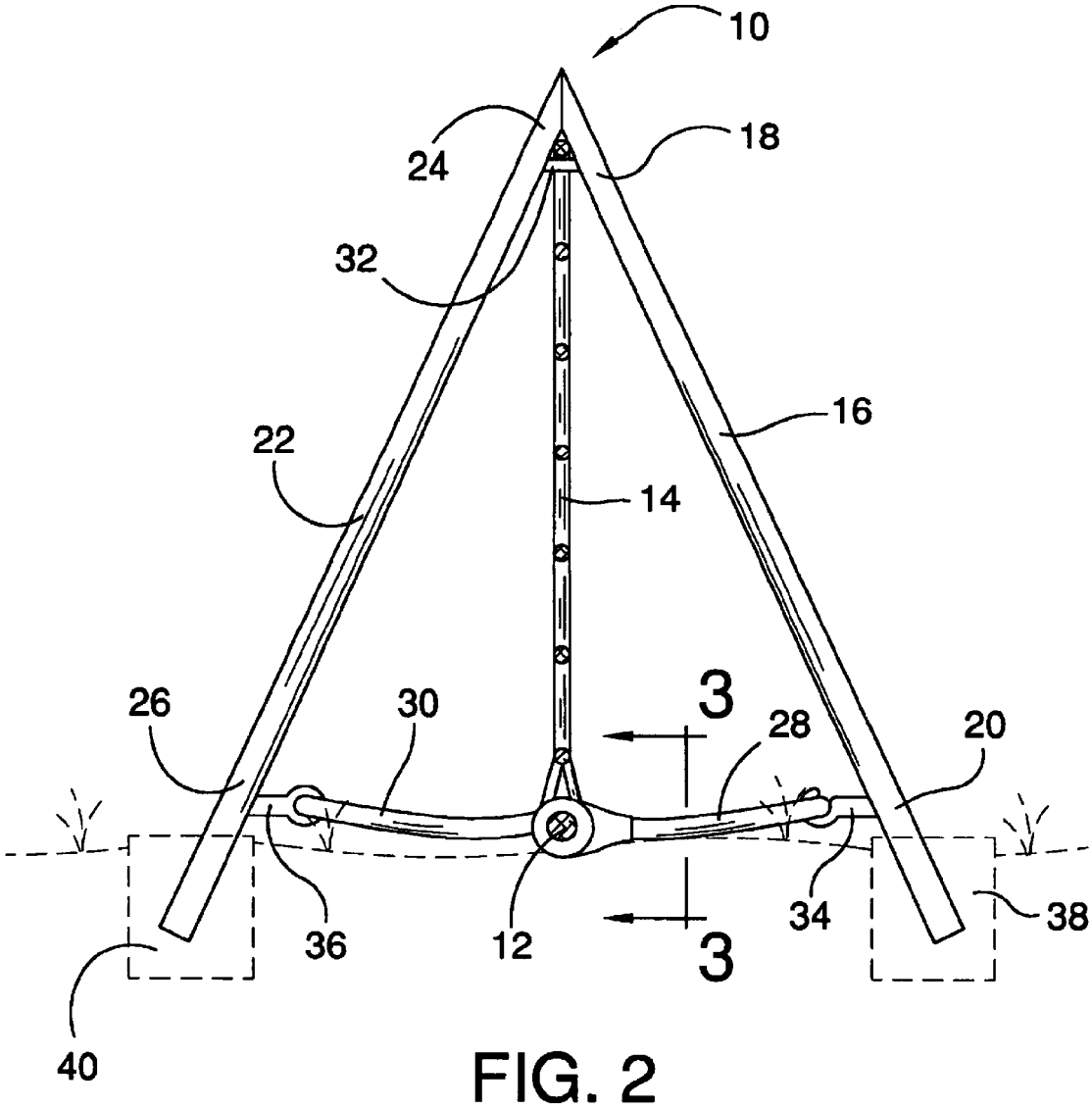
FIG. 2 is a section 2—2 view of FIG. 1 of the highway safety net of the present invention.

In FIG. 2, the highway safety net 10 is illustrated and will be described. More particularly, the highway safety net 10 has the netting 14 connected to the lower cable 12. The lower cable 12 is steel braid in the present example. A first post 16 has the first post top 18 and a first post bottom 20. The first post top 18 is connected to the netting 14 for supporting the netting 14. A second post 22 has the second post top 24 and a second post bottom 26. The second post top 24 is connected to the first post top 18. A first stabilizer bar 28 is rotatably connected to the lower cable 12. The first stabilizer bar 28 is connected adjacent to the first post bottom 20. A second stabilizer bar 30 is rotatably connected to the lower cable 12. The second stabilizer bar 30 is connected adjacent to the second post bottom 26. A catch 32 is connected to the first post top 18. The catch 32 is connectable to the second post top 24. The catch 32 is for supporting the net 14. A first stabilizer hook 34 is connected to the first post 16. The first stabilizer hook 34 is detachably connectable to the first stabilizer bar 28. A second stabilizer hook 36 is connected to the second post 22. The second stabilizer hook 36 is detachably connectable to the second stabilizer bar 30. A first cement footing 38 is connected to the first post bottom 20. A second cement footing 40 is connected to the second post bottom 26.

Figure 3:
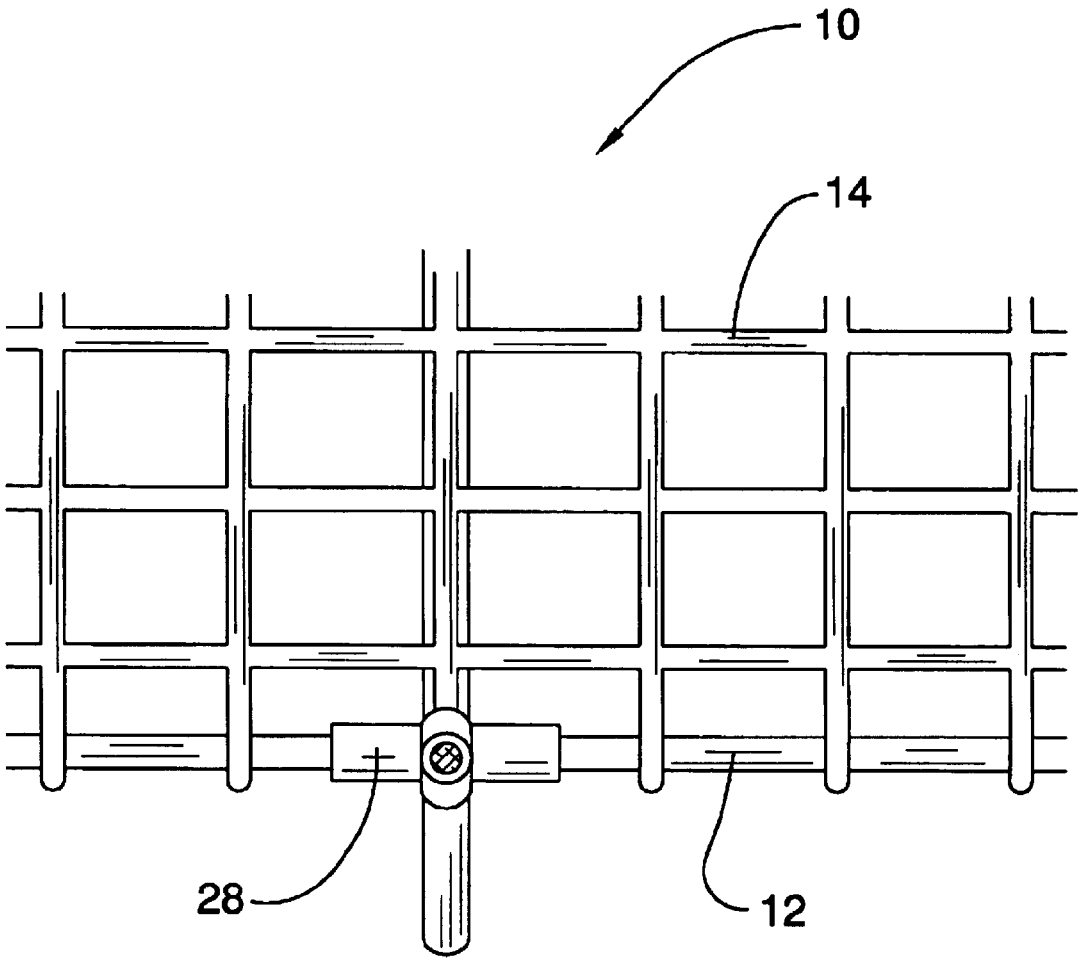
FIG. 3 is a section 3—3 view of FIG. 2 of the highway safety net of the present invention.

In FIG. 3, the highway safety net 10 is illustrated and will be described. More particularly, the highway safety net 10 has the netting 14 connected to the lower cable 12. The first stabilizer bar 28 is rotatably connected to the lower cable 12.

Figure 4:
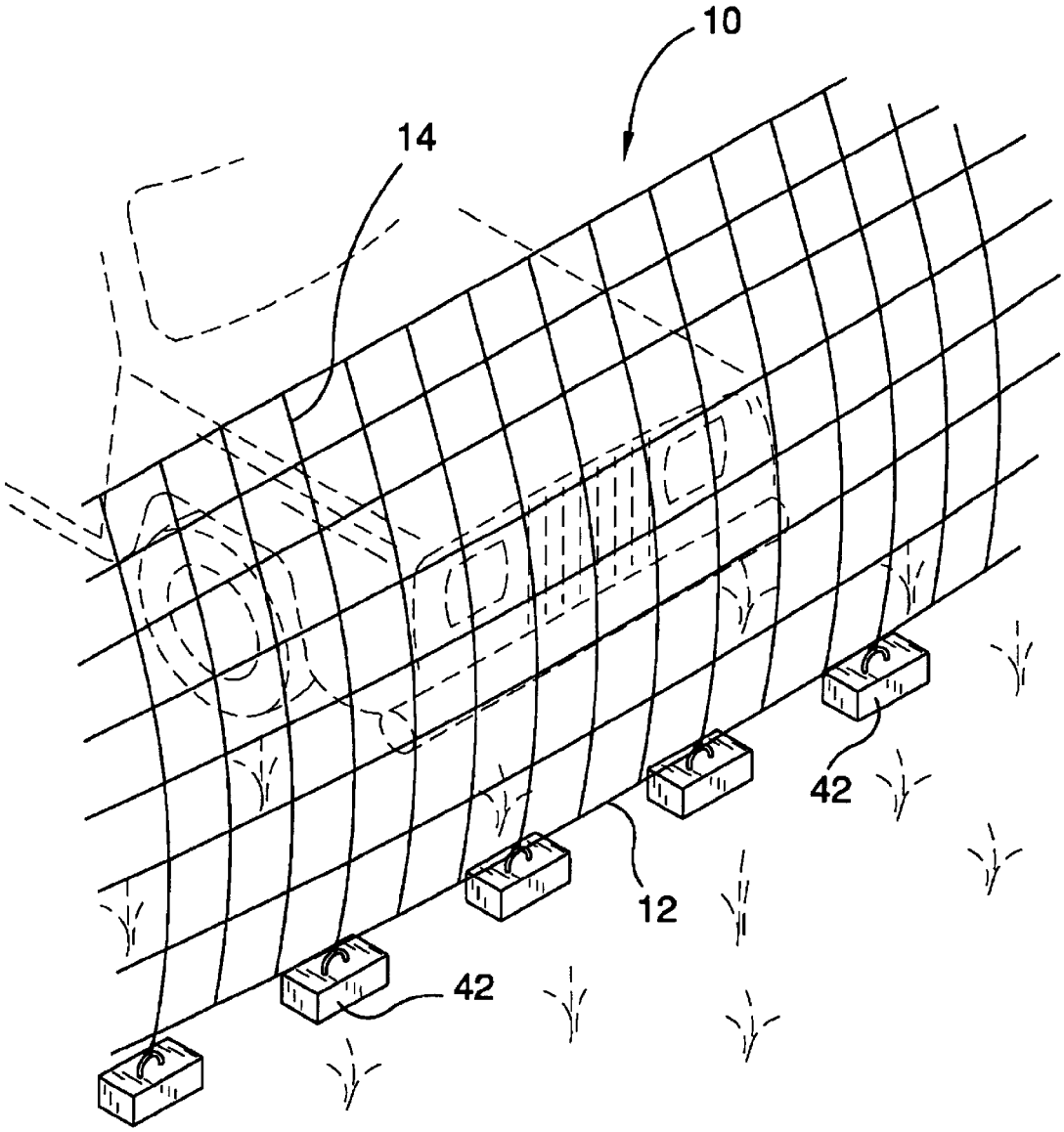
FIG. 4 is a top perspective view of a second embodiment of the highway safety net of the present invention.

In FIG. 4, the highway safety net 10 is illustrated and will be described. More particularly, the highway safety net 10 has the netting 14 connected to the lower cable 12. A plurality of cable weights 42 are connected to the lower cable 12 in the second embodiment. Those skilled in the art will readily recognize that a strong, heavy cable or other anchoring devices could be used in place of said plurality of cable weights 42 without deviating from the spirit and scope of the invention.

In use it can now be seen that in the event a driver is involved in an event in which the vehicle suddenly steers into the grass median and towards the opposite direction of traffic, it would be intercepted by the highway safety net 10. Once the vehicle strikes the strong webbing the weight of the lower cable 12 would drag the vehicle to a stop. The vehicle thus would be quickly decelerated and stopped in a safe and controlled manner before it could enter the opposite direction of traffic and cause a major accident.

While a preferred embodiment of the highway safety net has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as composite mesh may be used instead of the metal netting described. And although self supporting highway barricade net have been described, it should be appreciated that the highway safety net herein described is also suitable for arresting aircraft which go beyond the tarmac.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A highway safety net comprising:

a lower cable;

a netting connected to said lower cable;

a first post having a first post top and a first post bottom, said first post top connected to said netting for supporting said netting;

a second post having a second post top and a second post bottom, said second post top connected to said first post top;

a first stabilizer bar connected to said lower cable, said first stabilizer bar connected adjacent to said first post bottom; and a first stabilizer hook connected to said first post, said first stabilizer hook detachably connectable to said first stabilizer bar.

2. A highway safety net comprising:

a lower cable;

a netting connected to said lower cable;

a first post having a first post top and a first post bottom, said first post top connected to said netting for supporting said netting;

a second post having a second post top and a second post bottom, said second post top connected to said first post top; and a first stabilizer bar connected to said lower cable, said first stabilizer bar connected adjacent to said first post bottom;

a second stabilizer bar connected to said lower cable, said second stabilizer bar connected adjacent to said second post bottom; and a second stabilizer hook connected to said second post, said second stabilizer hook detachably connectable to said second stabilizer bar.

3. A highway safety net comprising:

a lower cable;

a netting connected to said lower cable;

a first post having a first post top and a first post bottom, said first post top connected to said netting for supporting said netting;

a second post having a second post top and a second post bottom, said second post top connected to said first post top;

a first stabilizer bar connected to said lower cable, said first stabilizer bar connected adjacent to said first post bottom;

a second stabilizer bar connected to said lower cable, said second stabilizer bar connected adjacent to said second post bottom;

a catch connected to said first post top, said catch connectable to said second post top, said catch for supporting said net; and a first stabilizer hook connected to said first post, said first stabilizer hook detachably connectable to said first stabilizer bar.

4. The highway safety net of claim 3 further comprising:

a second stabilizer hook connected to said second post, said second stabilizer hook detachably connectable to said second stabilizer bar.

5. A highway safety net comprising:

a lower cable;

a netting connected to said lower cable;

a first post having a first post top and a first post bottom, said first post top connected to said netting for supporting said netting;

a second post having a second post top and a second post bottom, said second post top connected to said first post top;

a first stabilizer bar rotatably connected to said lower cable, said first stabilizer bar connected adjacent to said first post bottom;

a second stabilizer bar rotatably connected to said lower cable, said second stabilizer bar connected adjacent to said second post bottom;

a catch connected to said first post top, said catch connectable to said second post top, said catch for supporting said net;

a first stabilizer hook connected to said first post, said first stabilizer hook detachably connectable to said first stabilizer bar;

a second stabilizer hook connected to said second post, said second stabilizer hook detachably connectable to said second stabilizer bar;

a first cement footing connected to said first post bottom; and a second cement footing connected to said second post bottom.

* * * * *